United States Patent [19]

Tsay

[11] Patent Number: 5,063,666

[45] Date of Patent: Nov. 12, 1991

[54] NAIL CLIPPER

[76] Inventor: Jaw-Shiunn Tsay, No. 40, Niu-Chou Tzu, Ling-Nan Village, Dung-Shan Hsiang, Tainan Hsien, Taiwan

[21] Appl. No.: 707,610

[22] Filed: May 30, 1991

[51] Int. Cl.[5] ..... A45D 29/00

[52] U.S. Cl. ..... 30/28; 132/75.5

[58] Field of Search ..... 30/28; 132/75.4, 75.5

[56] References Cited

U.S. PATENT DOCUMENTS 3,189,996 6/1963 Casey ..... 30/28

4,809,431 3/1989 Idema ..... 30/28

4,819,673 4/1989 McMullen ..... 30/28 X 4,996,771 3/1991 Williams ..... 30/28

*Primary Examiner*—Douglas D. Watts

*Attorney, Agent, or Firm*—Bacon & Thomas

[57] ABSTRACT

A nail clipper comprising an elongate lever, a short upper body, and a long lower body combined together with a joint pin at their front, the upper and lower bodies having separate cutting edges at both front sides to form two pairs of cutting edges for clipping nails, the cutting edges extending parallel to the longitudinal direction of the clipper.

1 Claim, 3 Drawing Sheets

NAIL CLIPPER

BACKGROUND OF THE INVENTION

A conventional nail clipper shown in FIGS. 1, 2 comprises a lever 10 having a triangle section 100 at its front side and a U-shaped opening 102 at its front end, a lower body 110 and an upper body 111 fixed together at their rear ends, a pin 12 inserted in through holes 112, 113 in both the bodies 110, 111 and in the U-shaped opening 102 in the lever 10, and a pin 13 inserted through a pin hole 101 in the lever 10 and a pin hole 121 in the pin 12 so that the lever 10 can be combined with and laid on the upper body 111. The upper body 111 and the lower body 110 have a pair of opposed curved cutting edges 114, 115 for cutting nails at the front end. The pin 12 has a larger sized bottom end 122 to engage the bottom surface of the lower body 111 so that the lower body 110 will not separate from the pin 12.

After this conventional nail clipper is assembled together as shown in FIG. 2, pressing down the lever 10 to compress the upper body 111 will force the lower body to move up so that the cutting edges 114, 115 can be closed tightly together to clip a nail positioned there between.

The above conventional nail clipper is considered to have the following disadvantages.

1. Fingers can easily slide off the clipper during use.
2. The cutting edges extend in a perpendicular direction with respect to the longitudinal direction of the clipper body, thus rendering the conventional clipper difficult to operate.

SUMMARY OF THE INVENTION

This invention provides an improved nail clipper more convenient to use than a conventional one.

The nail clipper in this present invention comprises an elongate lever, a short upper body, a long lower body and a joint pin to assemble the lever and both the upper and the lower body together at their front sections so that the lever can be pressed down to compress the upper body downward on the lower body, and two opposed pairs of curved cutting edges provided on opposite sides of the upper and the lower bodies can be accordingly closed tightly together to clip nails.

Since the two pairs of cutting edges are each positioned parallel to the longitudinal direction of the clipper body, this nail clipper is easy to hold by the fingers, and even by a palm and more convenient than a conventional one to operate in moving to clip the nails of both hands.

DETAILED DESCRIPTION OF THE INVENTION

Figure 1:
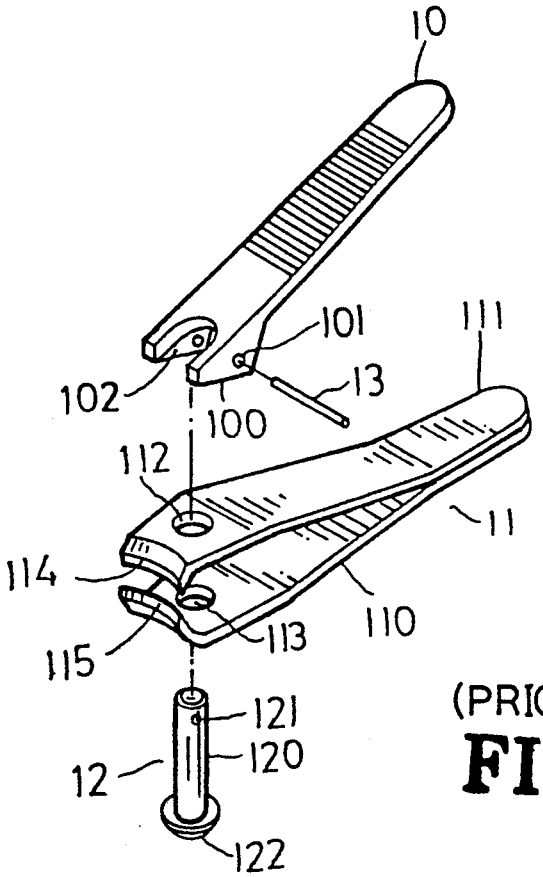
(PRIOR ART) FIG. 1
FIG. 1 is an exploded perspective view of a conventional nail clipper.
Figure 2:
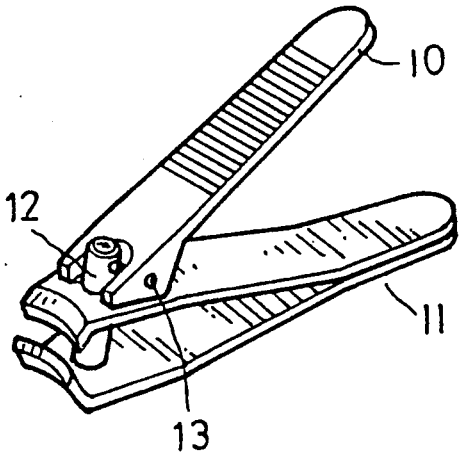
(PRIOR ART) FIG. 2
FIG. 2 is a perspective view of a conventional nail clipper.
Figure 3:
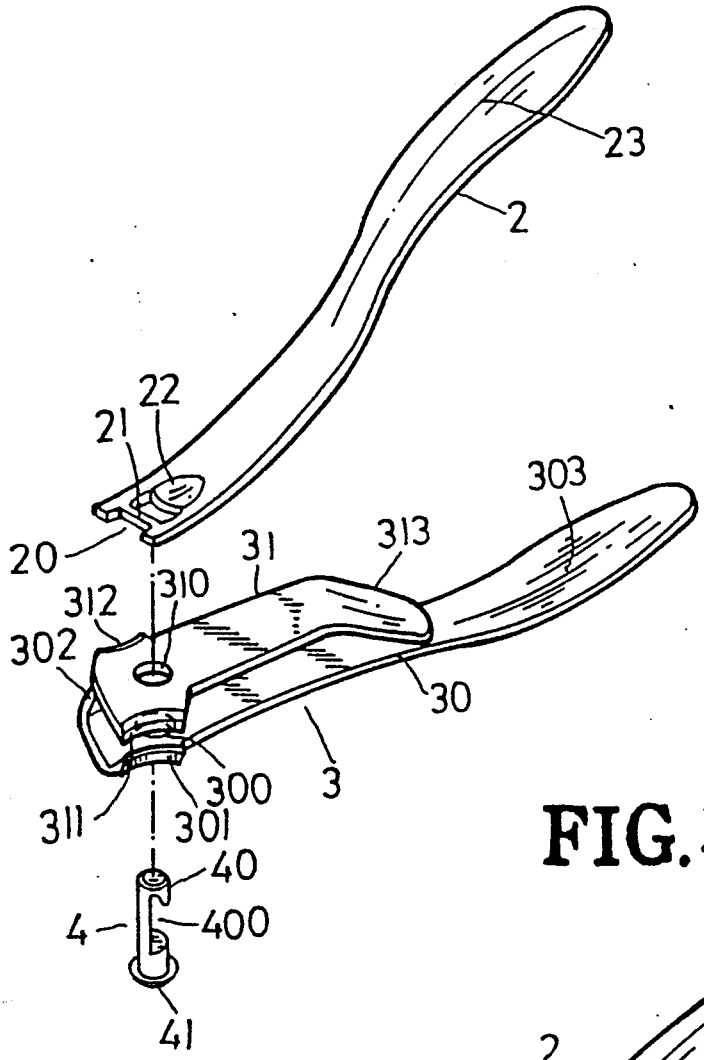
FIG. 3 is an exploded perspective view of the nail clipper of the present invention.
Figure 4:
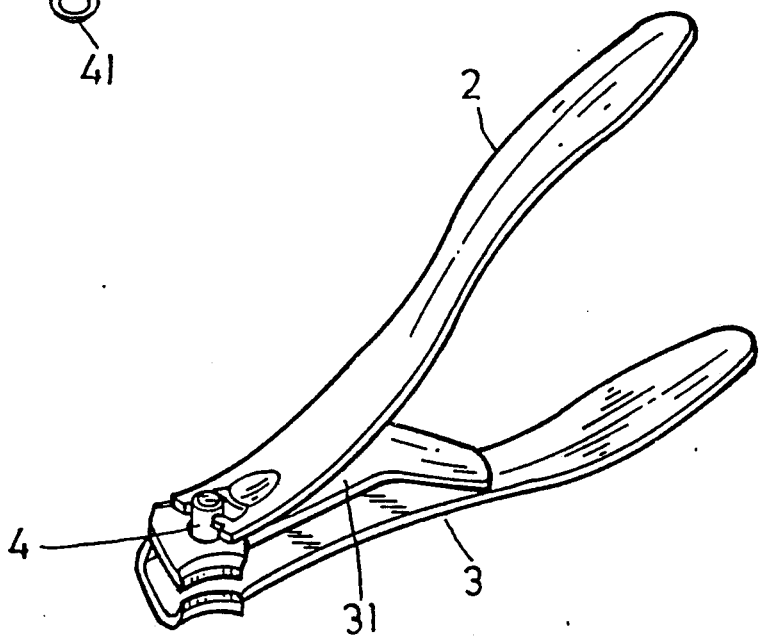
FIG. 4 is a perspective view of an assembled nail clipper of the present invention.

The nail clipper of the present invention, as shown in FIGS. 3, 4, comprises a slightly curved lever 2, a body 3 having an upper body 31 and a lower body 30, and a joint pin 4 as the main components.

The lever 2 is slightly curved toward the rear end, having a U-shaped notch 20 at the front end, a crosswise bar 21 just behind the notch 20, a projection 22 on the surface behind the crosswise bar 21 and a curved rear section 23.

The body 3 is pivotally assembled under the lever 2 by means of the joint pin 4, having a short upper body 31 and a long lower body 30 fixed together at the front end of the upper body. the upper body 31 having a pin hole 310 for receiving the joint pin 4 to go through. The cutting edges 311, 312 are provided at the front two opposite sides of body 31 beside the pin hole 310 and a slightly bent-down rear section 313 of body 31 functions as an elastic body. The lower body 30 has a pin hole 300 at the front corresponding to the pin hole 310, cutting edges 301, 302 at the front two opposite sides beside the pin hole 300 and a curved rear section 303.

Figure 5:
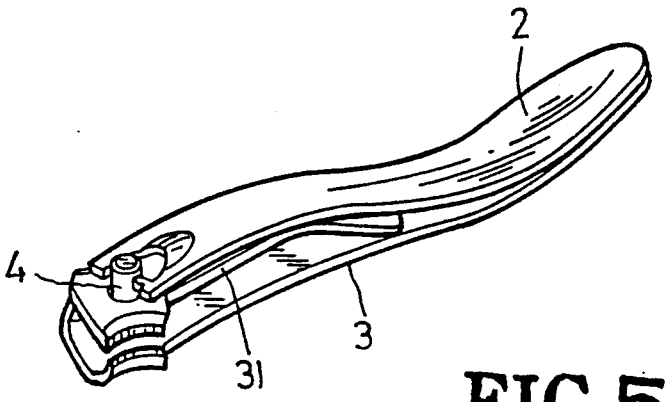
FIG. 5 is a perspective view of the nail clipper of the present invention shown folded for storage.

The joint pin 4 has a rod 40, a C-shaped notch 400 at the middle section and a engage end 41 to stop the lower body 30 and prevent it from falling off. In assembling, the joint pin 4 is inserted through the pin holes 300, 310, projecting up out of the upper body 31, permitting its notch 400 to be hooked thereto by engagement with the crosswise bar 21 so that the lever 2 and the body 3 can be assembled together by means of the joint pin 4, as shown in FIGS. 4, 5. The joint pin 4 is rotatable by turning the lever 2.

Figure 6:
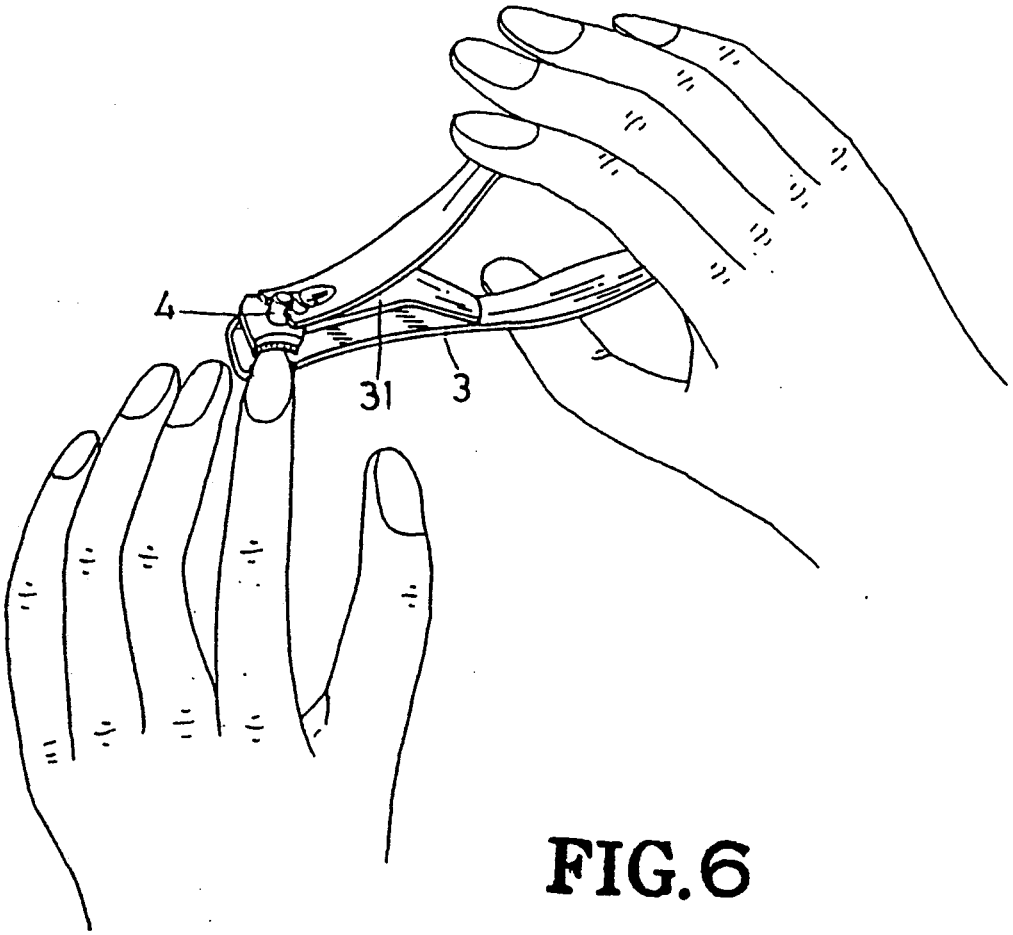
FIG. 6 is a perspective view of the nail clipper of the present invention shown unfolded and in a position of use.

In using this nail clipper, as shown in FIG. 6, the lever 2 and the lower body 30 are held by fingers at their rear sections, and then the nail to be clipped is inserted in the space between the cutting edges 301 and 311 or 302 and 312. Then pressing down the lever 2 will force the projection 22 in the lever 2 to compress the upper body 31 so that the opposed pairs of cutting edges 301 and 311, 302 and 312 to be closed tightly together to clip a nail.

The nail clipper in this invention is deemed to have the following advantages.

1. It is easy to hold and press with the fingers, even with a palm, without slipping off.
2. The cutting edges are located in the perpendicular direction to the fingers holding the lever but parallel to the clipper body, making it very convenient and natural to operate this nail clipper.
3. It is easy to use, as it has two pairs of cutting edges, especially when it is to be moved to clip nails on the other hand after finishing one hand.

What is claimed is:

1. A nail clipper comprising:

a) an elongate lever including a front end, an upper surface and a curved rear section, a U-shaped notch at the front end, a crosswise bar behind the notch, and a projection on the upper surface behind the crosswise bar;

b) a lower body having a front end and a curved rear section, the curved rear sections of the lever and lower body being of substantially the same curvature and disposable in an overlapping relationship, a pin hole at the front end of the lower body and a pair of separate curved cutting edges extending upwardly on opposite sides of the front end adjacent the pin hole;

c) an upper body including a front end and an elastic bent-down rear section, a pin hole at the front end and a pair of separate curved cutting edges extending downwardly on opposite sides of the front end, the cutting edges of the upper body corresponding to the cutting edges of the lower body to define two pairs of opposed cutting edges;

d) a joint pin of rod-shaped configuration having upper and lower ends, a C-shaped notch formed between the upper and lower ends, and a stop edge at the lower end; and e) the joint pin being insertable through the pin holes of the upper and lower bodies for engaging the stop edge against the lower body and the C-shaped notch around the cross-wise bar of the lever to assemble the clipper together, whereby the lever is rotatable about the joint pin and disposable between an upwardly extending position of use and a downwardly extending folded position for storage in which the curved rear sections of the lever and lower body are disposed in the overlapping relationship, and the elastic bent-down rear section of the upper body serving to restore the upper body and the lever to their original positions after the lever is pressed downwardly towards the lower body during a clipping operation.

* * * * *